US006450607B1

(12) United States Patent
Bolash et al.

(10) Patent No.: US 6,450,607 B1
(45) Date of Patent: Sep. 17, 2002

(54) ALIGNMENT METHOD FOR COLOR INK JET PRINTER

(75) Inventors: John Philip Bolash; Jim Dal Freeze; Duane Edward Norris, all of Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 20 days.

(21) Appl. No.: 09/663,619

(22) Filed: Sep. 15, 2000

(51) Int. Cl.[7] ..... B41J 2/01
(52) U.S. Cl. ..... 347/19
(58) Field of Search ..... 347/19, 37, 43; 358/504; 400/74

(56) References Cited

U.S. PATENT DOCUMENTS

| | | | | |
|---|---|---|---|---|
| 4,878,063 A | | 10/1989 | Katerberg | |
| 5,250,956 A | | 10/1993 | Haselby et al. | |
| 5,276,467 A | | 1/1994 | Meyer et al. | |
| 5,289,208 A | | 2/1994 | Haselby | |
| 5,297,017 A | | 3/1994 | Haselby et al. | |
| 5,350,929 A | | 9/1994 | Meyer et al. | |
| 5,434,956 A | | 7/1995 | Son et al. | |
| 5,448,269 A | | 9/1995 | Beauchamp et al. | |
| 5,451,990 A | | 9/1995 | Sorenson et al. | |
| 5,530,460 A | | 6/1996 | Wehl | |
| 5,561,449 A | | 10/1996 | Raskin et al. | |
| 5,751,305 A | | 5/1998 | Hadley | |
| 5,764,254 A | | 6/1998 | Nicoloff, Jr. et al. | |
| 5,847,722 A | | 12/1998 | Hackleman | |
| 5,909,974 A | | 6/1999 | Myung | |
| 6,109,722 A | * | 8/2000 | Underwood et al. | 347/19 |
| 6,164,749 A | * | 12/2000 | Williams | 347/19 |
| 6,297,888 B1 | * | 10/2001 | Noyes et al. | 358/1.9 |

FOREIGN PATENT DOCUMENTS

| | | | | |
|---|---|---|---|---|
| EP | 0589718 A1 | * | 3/1994 | 347/19 |

* cited by examiner

*Primary Examiner*—Craig A. Hallacher
(74) *Attorney, Agent, or Firm*—Luedeka,Neely & Graham, P.C.; Brent Lambert

(57) ABSTRACT

The invention provides a method for aligning multiple color ink jet printheads to provide ink droplet placement within about 1/600 inch of desired droplet location. The method includes providing an ink jet printer containing a printhead carriage for retaining a black ink printhead and a multi-color ink printhead thereon. The black ink printhead contains a black ink pen and the color ink printhead preferably contains at least two pens for providing droplets of ink on a print media. A color pen is selected to provide reference vertical and horizontal alignment patterns rather than using a black pen as the reference color. This enables a smaller error for alignment than provided with conventional alignment patterns.

35 Claims, 7 Drawing Sheets

ALIGNMENT METHOD FOR COLOR INK JET PRINTER

FIELD OF THE INVENTION

The invention relates to a method for aligning color ink jet pens for an ink jet printer in order to provide improved quality and print resolution.

BACKGROUND OF THE INVENTION

In multicolor ink jet printers, print quality is a function of accurate droplet placement on a print media. Incorrect droplet placement for a particular pixel location may be caused by the physical location of the nozzles of a pen as a result of pen alignment relative to another color pen or by differences in the drop flight time between different color pens. Regardless of the cause of the misalignment problems, alignment of the pens is critical to providing improved print quality.

Various means have been used to align pens. For example, the horizontal and vertical print alignment of two pens in an ink jet printer may be accomplished by delaying or advancing the ink droplet ejection from one of the pens. For vertical alignment, the delay/advance of ink droplet ejection is in the print passes while for horizontal alignment, the delay/advance of ink droplet ejection is in drop placement within a single print pass. However, for a printer containing three or more pens, alignment processes become much more difficult, particularly for increased print resolution. When three pens in a printer are operated simultaneously, conventional methods for advancing or delaying ink droplet ejection from the pens may not be able to provide a desired print resolution. A further alignment complication is introduced when the printer also contains a separate black ink jet pen. Misalignment of the ink droplets from the black and color ink jet pens greatly reduces the print quality provided by such an ink jet printer.

U.S. Pat. No. 4,878,063 to Katerberg describes a method for detecting misalignment and correcting register of color separation planes on a print medium. The color planes of the cyan, magenta and yellow color components of an image are said to be adjusted relative to the color plane of a black component of the image. According to the '063 patent, lines of a first color printing subsystem are printed in an array of M parallel lines which are uniformly spaced N spaces from a base registration line located in the center of the array of parallel lines. A second array of M parallel lines of a second color printing subsystem are printed so that they are uniformly spaced apart N+1 spaces from a base registration line located in the center of the second array of parallel lines. The second array of parallel lines is said to be predeterminedly juxtaposed with respect to the first array of parallel lines in order to determine when the base registration marks of the first and second arrays are aligned. After visually inspecting the marks of the two arrays, a user selects the adjacent line mark pair of the juxtaposed arrays which are in the best alignment and this selection is stored in the printer memory. The stored data is said to be used to adjust the relative column print positions of the print heads by appropriate increments of adjustment steps. In the foregoing described method, the printhead is moved in both swath directions relative to a center position to provide the reference line arrays.

Despite the abundance of methods for color pen alignment, there continues to be a need for improved methods for aligning pens for multi-color ink jet printers in order to provide improved print resolution.

SUMMARY OF THE INVENTION

With regard to the foregoing, the invention provides a method for aligning multiple color ink jet pens to provide ink droplet placement within 1/600 inch of desired droplet location. The method includes providing an ink jet printer containing a printhead carriage for retaining a black ink printhead and a multi-color ink printhead thereon. The black ink printhead contains a black ink pen and the color ink printhead preferably contains at least two pens for providing ink droplets on a print media.

According to the method, the carriage is first set to an initial first position with respect to a first swath direction across a print media. The carriage is then moved across the print media in the first swath direction with respect to the initial first position. As the carriage is moved across the print media, ink droplets are deposited from a first color ink pen to provide a series of first vertical line segments across a width of the print media, each of the first vertical line segments being spaced a first constant separation distance from a previously printed first vertical line segment. Ink droplets are also deposited on the print media from a second color ink pen to provide a series of second vertical line segments across the print media, each of the second vertical line segments being spaced a second constant separation distance from a previously printed second vertical line segment. A combination of the first and second series of vertical line segments provides a first alignment pattern.

The carriage is then reset to the initial first position with respect to the first swath direction across the print media. As the carriage is again moved across the print media in the first swath direction, ink droplets are deposited from the first color ink pen to provide a series of third vertical line segments across a width of the print media, each of the third vertical line segments being spaced a first constant separation distance from a previously printed third vertical line segment. The carriage is then optionally reset to an initial second position with respect to the first swath direction across the print media. As the carriage is moved across the print media in the first direction from the initial second position, ink droplets from the black ink pen are deposited on the print media to provide a series of fourth vertical line segments across the print media, each of the fourth vertical line segments being spaced a fourth constant separation distance from a previously printed fourth vertical line segment. The combination of third and fourth series of vertical line segments provides a second alignment pattern.

The vertical line segments of the first alignment pattern are then visually inspected and a set of line segments which are in substantial horizontal alignment with one another is selected. Likewise, a set of line segments from the second alignment pattern which are in substantial horizontal alignment with one another is selected and the selected line segments are provided to a substantially permanent printer memory location.

In another aspect the invention provides a method for aligning multiple color ink jet printheads to provide ink droplet placement within 1/600 inch of desired droplet location. The method includes providing an ink jet printer containing a printhead carriage for retaining a black ink printhead and a multi-color ink printhead thereon, the black ink printhead containing a black ink pen and the color ink printhead containing at least two pens for providing ink droplets on a print media. The carriage is set to an initial first position with respect to a first swath direction across a print media. As the carriage is moved across the print media in the first swath direction with respect to the initial first position, ink droplets are deposited from a first ink pen to provide a series of first vertical line segments across a width of the print media, each of the first vertical line segments being spaced a first constant separation distance from a previously printed first vertical line segment.

The carriage is then set to an initial second position with respect to a second swath direction opposite the first swath direction across a print media. As the carriage is moved across the print media in the second swath direction with respect to the initial second position, ink droplets are deposited from a black ink pen to provide a series of second vertical line segments across the print media, each of the second vertical line segments being spaced a second constant separation distance from a previously printed second vertical line segment. The combination of first and second series of vertical line segments provides a first alignment pattern.

The carriage is again reset to the initial first position with respect to the first swath direction across the print media. As the carriage is moved across the print media in the first swath direction with respect to the initial first position, ink droplets are deposited from a second ink pen other than black to provide a series of third vertical line segments across a width of the print media, each of the third vertical line segments being spaced a first constant separation distance from a previously printed third vertical line segment.

The carriage is then set to the initial second position with respect to the second swath direction opposite the first swath direction across the print media, and is moved across the print media in the second direction from the initial second position, while depositing ink droplets from the black ink pen to provide a series of fourth vertical line segments across the print media, each of the fourth vertical line segments being spaced a fourth constant separation distance from a previously printed fourth vertical line segment. The combination of third and fourth series of vertical line segments provides a second alignment pattern. For higher resolution printing, it is preferred to provide the second and fourth vertical line segments using two passes of the black ink pen across the print media.

After printing the line segments, the line segments of the first alignment pattern are visually inspected and a set of line segments which are in substantial horizontal alignment with one another is selected. Likewise, a set of line segments of the second alignment pattern which are in substantial horizontal alignment with one another is selected. The selected set of line segments are then provided to a printer memory location.

A feature of the invention is that individual pen alignment is based on a reference color other than black except when printing with black ink only. Accordingly, print resolution may be adapted to provide ink droplets within 1/600 of an inch and/or 1/1200 of an inch of the desired droplet location. In contrast, when black is selected as a reference color for pen alignment the alignment error factor has been found to be two to three times the error factor obtained from use of a reference color other than black.

BRIEF DESCRIPTION OF THE DRAWINGS:

Further advantages of the invention will become apparent by reference to the detailed description when considered in conjunction with the figures, which are not to scale, wherein like reference numbers indicate like elements, and wherein.

Figure 1:
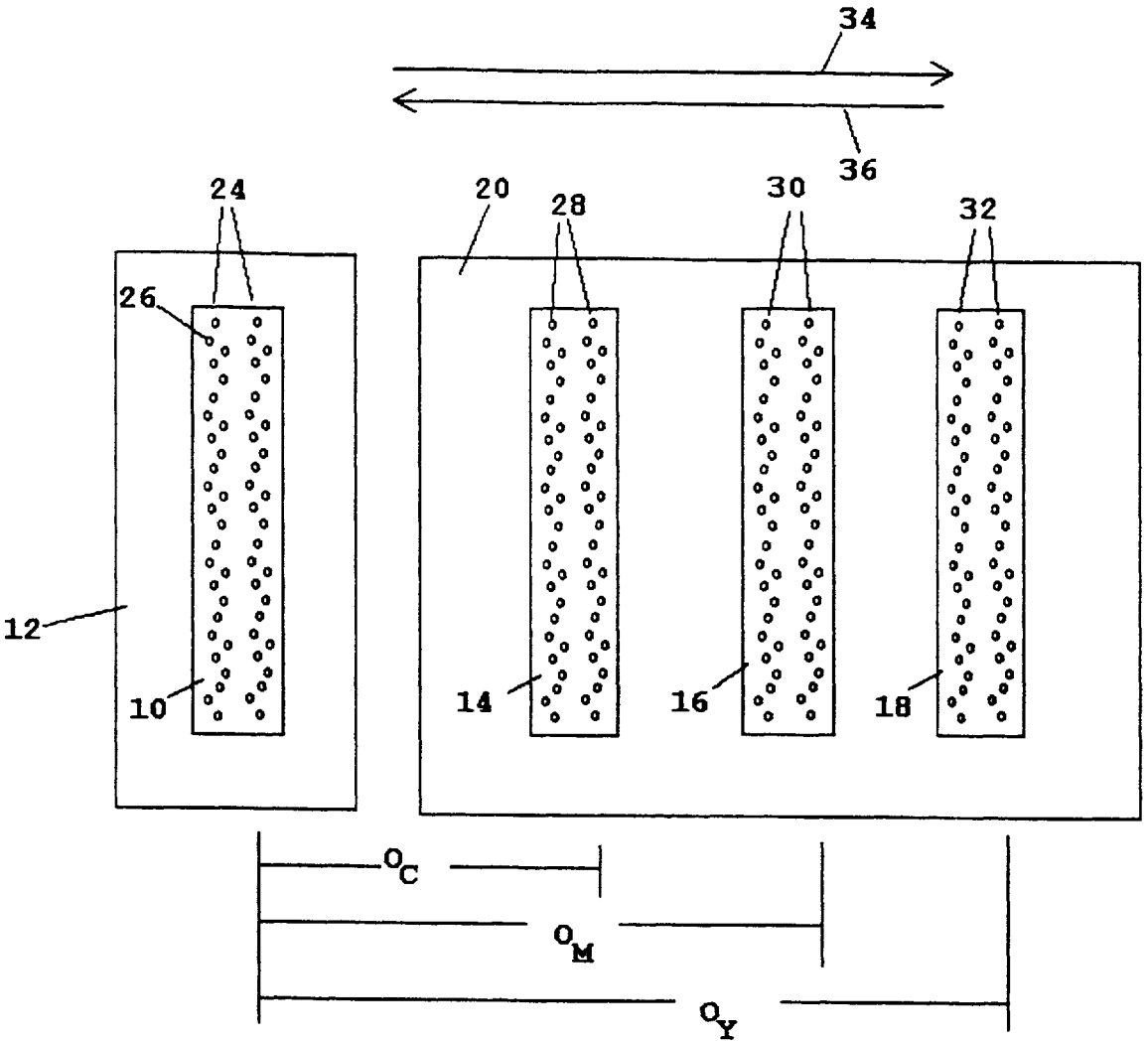
FIGS. 1 and 2 are plan views of printheads according to the invention.
Figure 2:
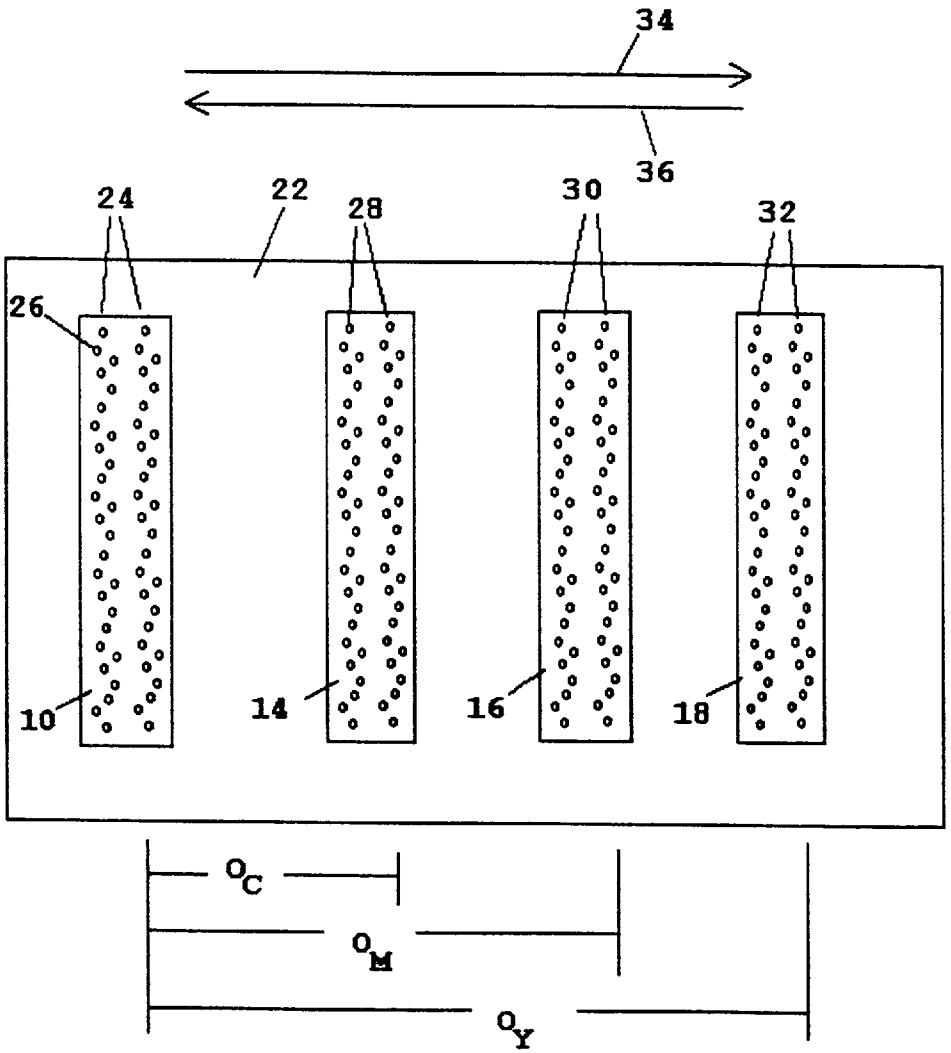

DETAILED DESCRIPTION OF A PREFERRED EMBODIMENT:

With reference to FIGS. 1 and 2, there is shown in plan view the arrangement of ink jet pens on one or more printheads for an ink jet printer. In FIG. 1, a black pen 10 is on a separate printhead 12 from color pens 14, 16 and 18 which are each contained on a printhead 20. In FIG. 2, a printhead 22 contains all four pens 10, 14, 16 and 18. Regardless whether the printheads 12, 20 and 22 contain one, three or four pens, the printheads 12 and 20 or 22 are attached to a carriage for translating the printheads 12, 20 and 22 across a print media. As the printheads are translated across the print media, ink droplets are expelled from nozzle holes associated with each pen. For example, pen 10 contains a nozzle array 24 containing a plurality of nozzle holes such as nozzle hole 26. Likewise, pen 14 contains nozzle array 28, pen 16 contains nozzle array 30 and pen 18 contains nozzle arrays 32.

The quality and resolution obtained from an ink jet printer is a function of the number of nozzle holes 26 and the spacing between adjacent nozzle holes 26 of each nozzle array of each pen. Despite the care taken to manufacture the pens, there is generally at least some misalignment of the pens from the theoretical pen locations both horizontally and vertically. Also, because more than one pen is attached to the printhead and/or more than one printhead is attached to the carriage, there is an inherent theoretical offset between nozzle arrays. The theoretical horizontal offset between the black pen 10 and the color pen 14, preferably cyan, is indicated by the designation $O_C$. The theoretical horizontal offset between the black pen 10 and the color pen 16, preferably magenta is indicated by the designation $O_M$ and the theoretical horizontal offset between the black pen 10 and the color pen 18, preferably yellow, is indicated by the designation $O_Y$. These offsets would be the actual values of the offsets if pens were perfectly positioned on the printheads and the ink droplets from the pens were perfectly placed on the paper.

Figure 3:
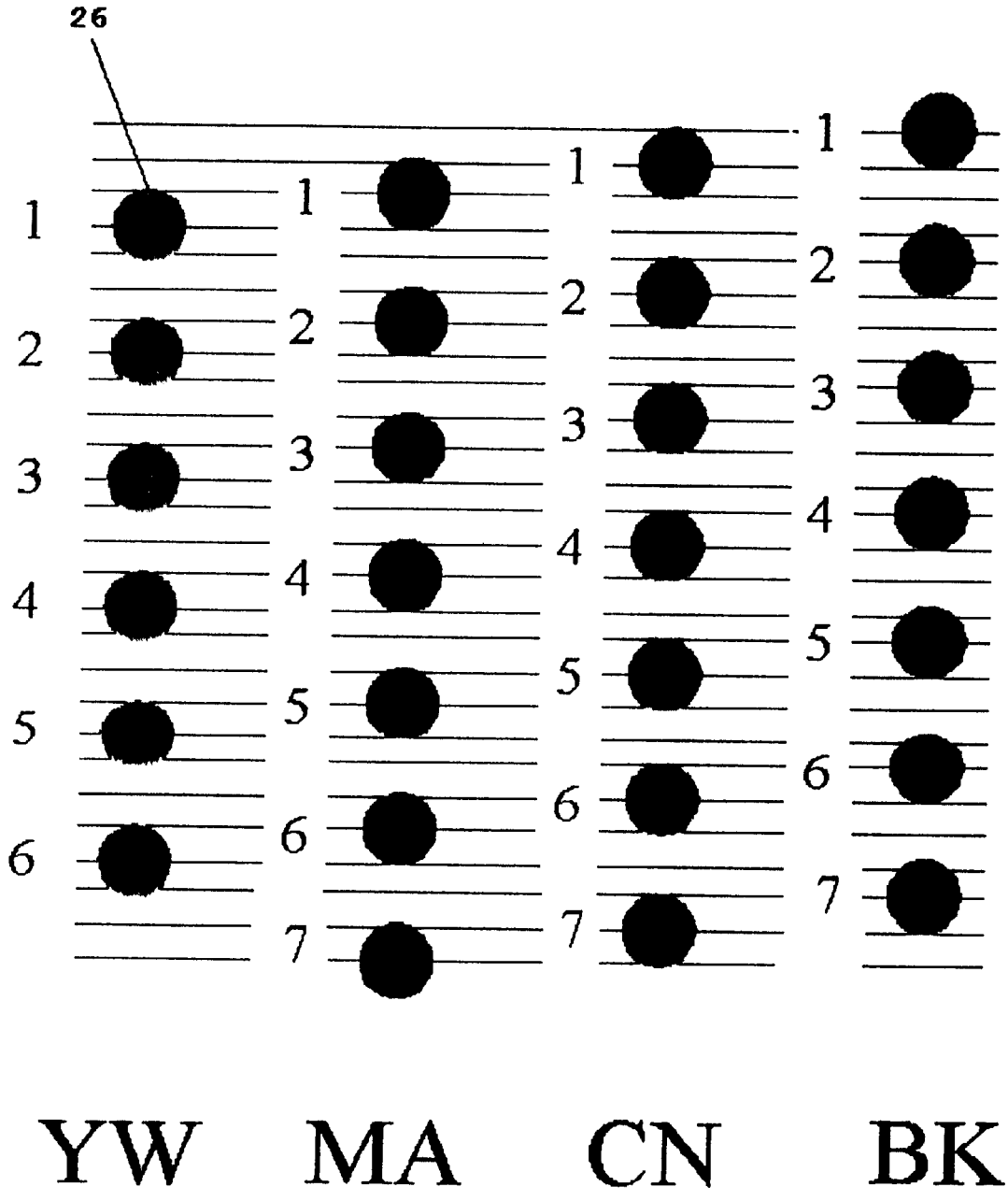
FIG. 3 is an illustration of the vertical offset of nozzle holes for an ink jet printhead according to the invention

Typically, the vertical offsets for nozzle holes for each pen associated with the same pixel location is assumed to be zero. However, there may be some vertical offset between such nozzle holes for each pen as seen in FIG. 3. For example, the first column YW of nozzle holes 26, numbered from 1–6, is offset vertically from the corresponding nozzle holes 26, numbered 1–7, in columns MA, CN and BK, wherein the YW column contains yellow nozzles, the MA column contains magenta nozzles, the CN column contains cyan nozzles and the BK column contains black nozzles. Accordingly, in order to minimize the vertical offset between the pens of each color, various nozzle hole locations may be selected from each pen to represent the same pixel location. For example, proceeding from left to right in FIG. 3, nozzle holes numbered 6, 6, 6, 6 may be selected as the same vertical nozzle hole locations even though they do not lie on the same horizontal line. Other possibilities would be to select nozzle holes 6, 6, 6, 7, nozzle holes 6, 6, 7, 7 or nozzle holes 5, 6, 6, 6. Regardless of the actual selection, all of the selected nozzle holes are assumed to lie along the same horizontal line so that the theoretical vertical offset is essentially zero. Bearing in mind the differences between ink ejection direction of pens due to manufacturing tolerances, it is important for improved print resolution to align the final dot placement for each pen both horizontally and vertically. During a printing operation, all three colors, cyan, magenta and yellow, are printed on the same carriage swath across the print media. However, the black ink is printed on a separate carriage swath across the print media either in the forward or reverse carriage swath direction. The forward swath direction is indicated by arrow 34 in FIGS. 1 and 2, while the reverse direction is indicated by arrow 36.

An alignment process is provided to produce the proper placement of the color dots with respect to one another and the proper positioning of the black dots relative to the color dots to provide a desired print resolution. In a preferred aspect of the invention, color or black ink dots destined for the same pixel location have a maximum error of 1/600 inch along x and y axes relative to a plane defined by the print media.

In the alignment process according to the invention, values are obtained along the x and y axes for alignment patterns printed from the pintheads travelling in the forward and/or reverse swath directions. Alignment patterns produced with the printheads travelling in the direction of arrow 34 are used for unidirectional alignment of the pens. Alignment patterns produced with the printheads travelling in both directions indicated by arrows 34 and 36 are used for bi-directional alignment of the pens. Unidirectional alignment of the pens may be performed by the printer manufacturer when the printer is made and these values are stored in a permanent printhead memory as factory default values, or unidirectional alignment may be performed by the printer user. Bi-directional alignment of the pens is performed by a user of the printer when setting up the printer to print the first time or when a new printhead is installed in the printer. The unidirectional alignment data and the bi-directional alignment data are combined and converted by the host-based printing software or the printer itself to values that indicate deviation from ideally aligned pens.

Alignment values obtained from the alignment patterns are input numerically by the user into the driver software and processed by an alignment algorithm which is described in more detail below. The alignment algorithm uses the numbers input by the user to produce an output which is used by the driver software for the printer to provide pen adjustment during printing operations. For a four color printer having black pen 10, cyan pen 14, magenta pen 16 and yellow pen 18, at least six unidirectional and at least two and preferably at least 3 bi-directional alignment patterns are used to align the pens along the x and y axes for a print resolution of 1/600 inch. The alignment patterns are contained in the following tables wherein CN represents the cyan pen 14, MA represents the magenta pen 16, YW represents the yellow pen 18 and BK represents the black pen 10. It will be recognized however, that the invention is applicable to a variety of printhead translational speeds and various alignment patterns, including but not limited to alignment patterns wherein dots are printed on one pass in a pattern of dots and spaces and the spaces filled in on a second pass of the printhead across the print media such as a checkerboard image pattern.

A fundamental aspect of the alignment process is the ability to calculate the required drop translation on the x and y axes from the alignment numbers supplied by the user. In addition, while the alignment patterns typically indicate relative displacement of pens with respect to Cyan (or any color pen), the alignment equations report the relative displacement of pens with respect to black. This has no affect on the accuracy of the alignment method, but enables the implementation of alignment of the pens to take place in a conventional manner.

According to the alignment process, a reference frame and coordinate system is established in order to define the alignment delta (or required drop correction movement). The reference frame is with respect to the pen. The coordinate system has its origin in the upper left-hand corner (0,0). A positive x value lies to the right of the origin and a positive y value lies below the origin. As a result, negative x value lies to the left of the origin and negative y value lies above the origin.

Since the reference frame is with respect to the pen, a positive x value indicates that the pen (or ink droplet) must be displaced a distance x to the right. Since the pen cannot be physically moved to compensate for the displacement error, the difference between the actual drop location and the desired drop location provided by the pen is implemented by a delay in firing of the specified ink droplet. A negative x value is achieved by advancing the time of ink droplet firing on the page.

For vertical displacement of the drop location with respect to the desired drop location, the ink droplets may be translated up (or down) by selecting a nozzle location from the nozzle array which compensates as nearly as possible for the vertical misalignment of the droplet.

The equations below report horizontal misalignment in 1/2400 inch and vertical misalignment in 1/1200 inch. The nine values computed by the alignment equations may be grouped into three bi-directional alignment values (BKK, BCK, BCC), three horizontal alignment values (HKC, HKM, HKY) and three vertical alignment values (VKC, VKM, VKY) wherein "B" represents bi-directional, "H" represents horizontal and "V" represents vertical. The letter "K" represents a black ink pen, "C" represents a cyan ink pen, "M" represents a magenta ink pen and "Y" represents a yellow ink pen. The user numbers are selected from alignment patterns A, B, C, D, E, F, G, H and I of FIGS. 4–7.

Accordingly, the alignment equations are given as follows:

$$BKK=2(A-15)$$
$$BCK=2(B-4D+10)$$
$$BCC=2(C-15)$$
$$HKC=40-4D$$
$$HKM=4(E-D)$$
$$HKY=4(F-D)$$
$$VKC=20-2G$$
$$VKM=2(H-G)$$
$$VKY=2(I-G)$$

Once calculated by the alignment algorithm, the nine alignment numbers are used to properly place ink on the page to achieve the alignment requirement of maximum drop separation of 1/600 inch. The foregoing tables provide means according to the invention for obtaining the alignment patterns A–I.

TABLE 1

| Pattern | Bi-directional Alignment X-axis Forward | Reverse |
|---|---|---|
| A | BK | BK |
| B | CN | BK |
| C | CN | CN |

TABLE 2

| Pattern | Forward | Forward |
|---|---|---|
| | Unidirectional Alignment X-axis | |
| D | CN | BK |
| E | CN | MA |
| F | CN | YW |
| | Unidirectional Alignment Y-axis | |
| G | CN | BK |
| H | CN | MA |
| I | CN | YW |

Figure 4:
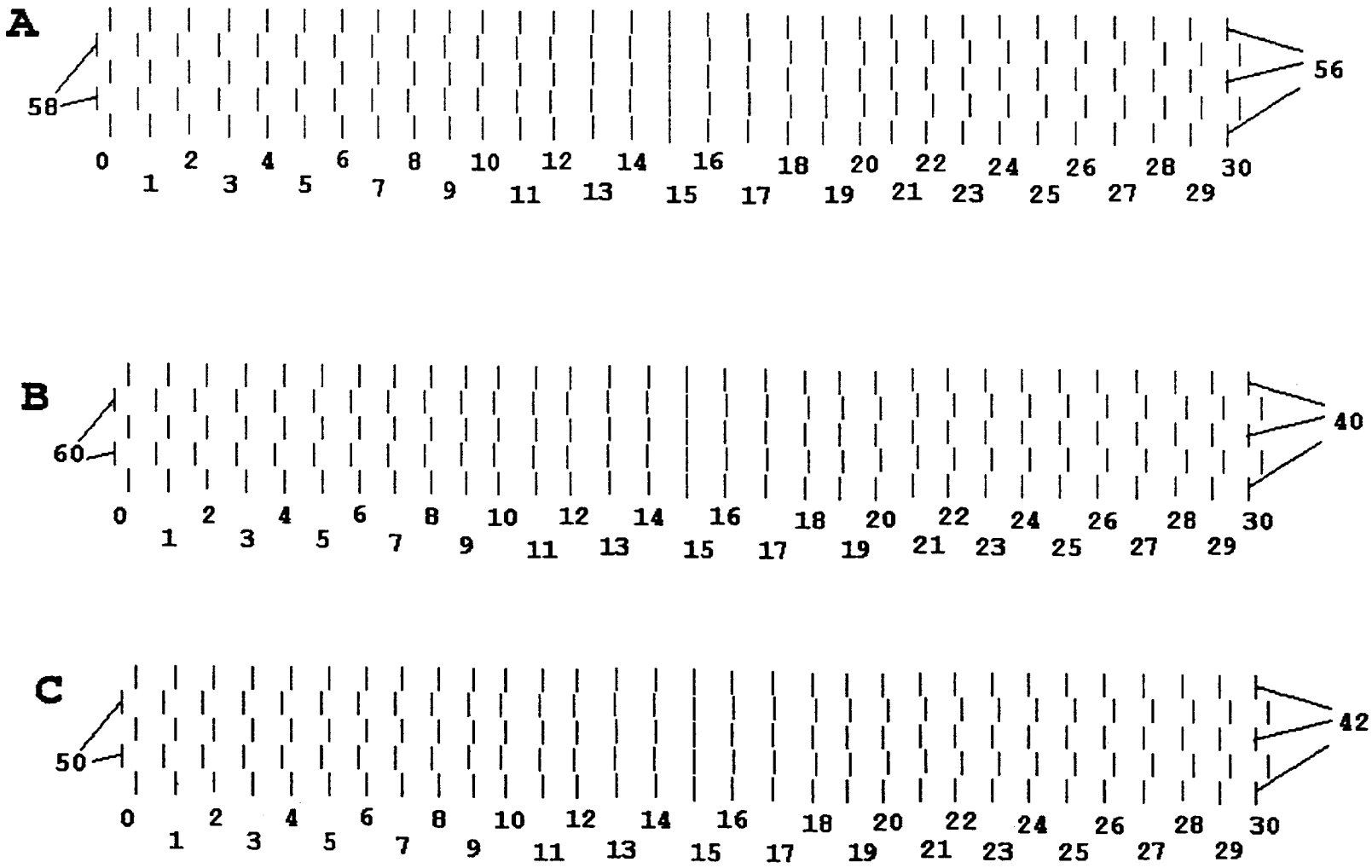
FIG. 4 is a set of vertical line arrays for a bi-directional alignment pattern for pens according to the invention.
Figure 5:
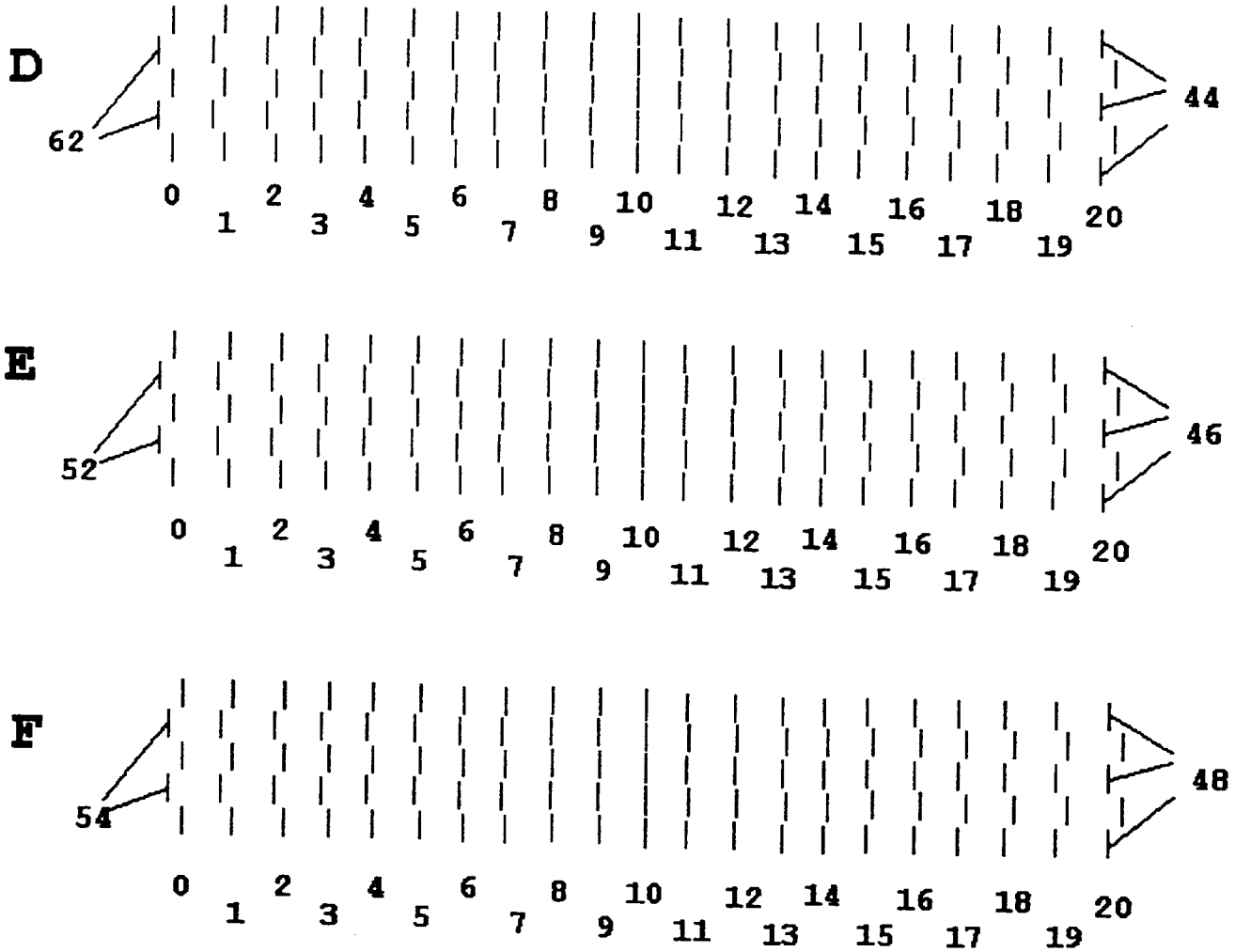
FIG. 5 is a set of vertical line arrays for unidirectional alignment pattern for pens according to the invention.
Figure 6:
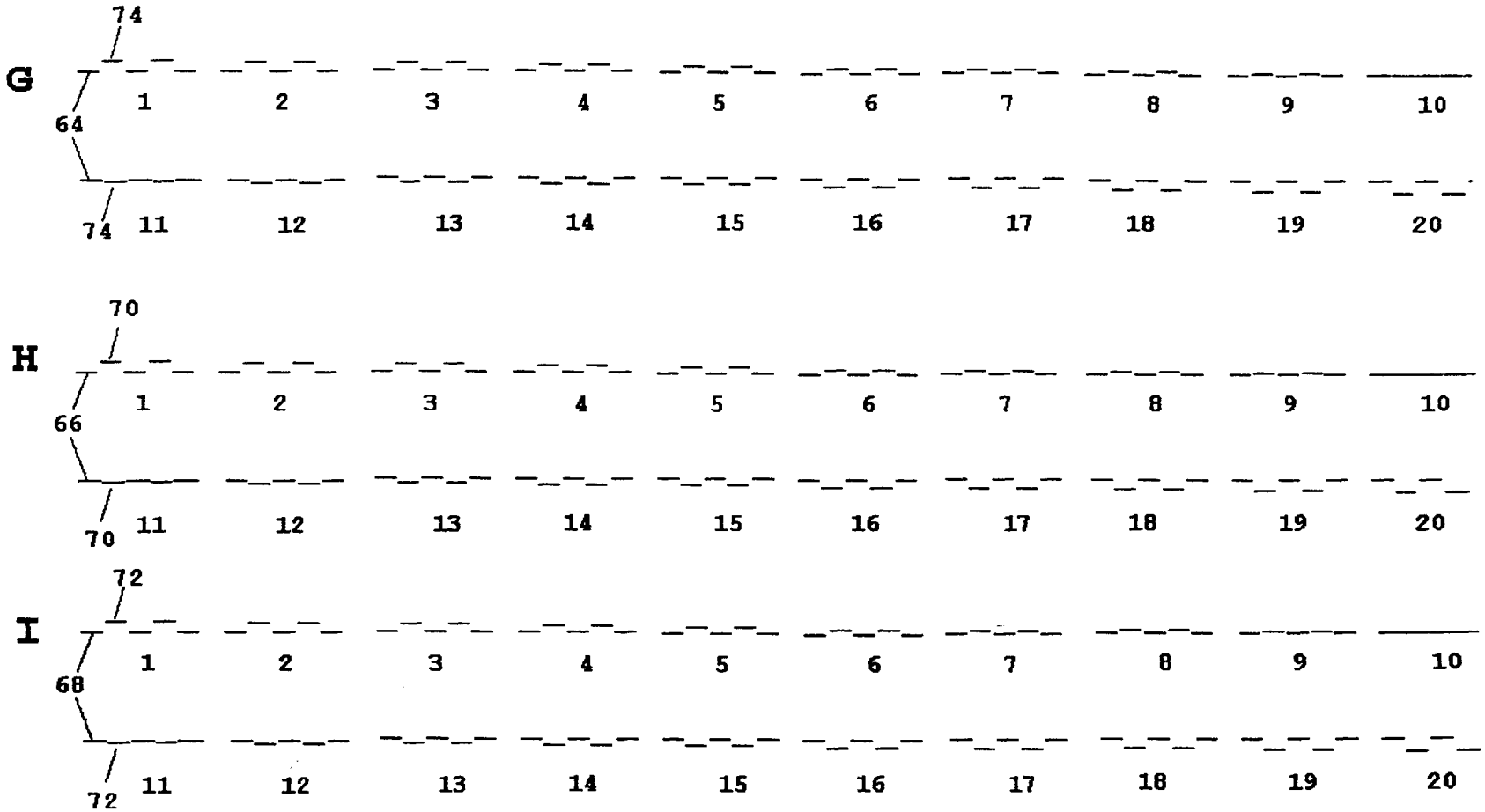
FIG. 6 is a set of horizontal line arrays for a vertical alignment pattern for pens according to the invention.

The patterns produced by the foregoing alignment sequences are illustrated by example in FIGS. 4–6. Thirty-one alignment marks are shown in FIG. 4 for each of the patterns A, B and C, the vertical marks being numbered from left to right from 0 to 30. The number of alignment marks in alignment patterns D, E and F as shown in FIG. 5 is 21. For the vertical alignment patterns G, H and I there are 20 alignment marks which are contained in two horizontal rows across the print media.

Only one swath of the carriage across the print media is required to print the reference color marks for the unidirectional and bi-directional alignment patterns and the offset black marks for the unidirectional alignment patterns. Two or more swaths of the carriage across the print media are required to print the offset black marks 58 and 60 in patterns A and B and the offset color marks 50 in pattern C for bi-directional alignment, while one swath of the carriage across the print media is required to print the offset color marks 52 and 54 in patterns E and F for unidirectional alignment. For example, in patterns B, C, D, E and F the cyan reference marks 40, 42, 44, 46 and 48 are printed on the first pass of the carriage across the print media. Also, every offset cyan, magenta and yellow mark 52 and 54 in patterns E and F would be printed on the first pass of the carriage across the print media. Since the reference and offset color marks are printed at the same time for the unidirectional alignment patterns, only one starting position is required for the carriage for printing the reference marks 40, 42, 44, 46 and 48 in patterns B, C, D, E and F and second starting position is required for the offset marks 52 and 54 in patterns E and F. The separation distances between the reference and offset lines may be the same or may be different for the alignment patterns generated according to the invention.

From a practical point of view, a printhead made according to the invention may be limited to printing a lower density line than required for alignment purposes. A high print density enables easy recognition and selection of the correct alignment marks during the alignment selection process. Accordingly, multiple passes of the carriage may be required for the desired print density for the reference and offset color marks, particularly when printing yellow as a reference or offset mark. In the alternative, the yellow reference or offset marks may be printed with a multiple line thickness in order to improve the visibility of the yellow marks.

The following equations account for practical limitations in print density which may be present in a printhead. It will be recognized that the invention contemplates a printhead which may be capable of printing a higher density alignment pattern in a single pass.

Accordingly, for the horizontal alignment patterns B through F with cyan as the reference color, the first starting position for the reference color marks 40, 42, 44, 46 and 48 in alignment patterns B, C, D, E and F is calculated by the following equation (I):

$$RSP_1=S_h+O_Y-O_C \tag{I}$$

wherein $RSP_1$ is the first starting position for the reference color marks 40, 42, 44, 46 and 48, $S_h$ is print media margin for the first reference pass, $O_Y$ is the theoretical offset distance between the yellow ink jet pen and the black ink jet pen, $O_C$ is the theoretical offset distance between the cyan ink jet pen and the black ink jet pen. In the above and following equations, the starting position has the implied units of 1/1200 of an inch. The internal separation distance between the banks of nozzle arrays is fixed by design during the manufacturing process for the pens and variations in the separation distance do not substantially effect the print resolution.

If a checkerboard image pattern is produced by the printer, then the second starting position for the reference color marks 40, 42, 44, 46 and 48 in patterns B, C, D, E and F is calculated by the following equation (II):

$$RSP_2=S_h+O_Y-O_C+NAS_C \tag{II}$$

wherein $RSP_2$ is the second starting position for the reference color marks 40, 42, 44, 46 and 48, $S_h$, $O_Y$ and $O_C$ are as set forth above and $NAS_C$ is the internal separation distance between two banks of nozzle arrays within a single color ink jet pen. The second starting position in equation II and in the following equations III–VI for the color marks is not used if all of the dots are printed in a single pass and the intensity of the printed lines is sufficient for alignment purposes. The first starting position for the offset magenta color marks 52 in pattern E is calculated by the following equation (III):

$$OMSP_1=S_h+O_Y-O_C-(L_h-1) \tag{III}$$

wherein $OMSP_1$ is the first starting position for the offset magenta color marks 52, $S_h$, $O_Y$ and $O_C$ are as defined above and $L_h$ is the number of vertical marks across the print media.

For a checkerboard image pattern, the second starting position for the offset magenta color marks 52 in pattern E is calculated by the following equation (IV):

$$OMSP_2=S_h+O_Y-O_C-(L_h-1)+NAS_C \tag{IV}$$

wherein $OMSP_2$ is the second starting position for the offset magenta color marks 52.

The first starting position for the offset yellow color marks 54 in pattern F is calculated by the following equation (V):

$$OYSP_1=S_h-(L_h-1) \tag{V}$$

wherein $OYSP_1$ is the first starting position for the offset yellow color marks 54, $S_h$ and $L_h$ are as defined above.

The second starting position for the offset yellow color marks 54 in pattern F is calculated by the following equation (VI):

$$OYSP_2=S_h-(L_h-1)+NAS_C \quad \text{(VI)}$$

wherein $OYSP_2$ is the second starting position for the offset yellow color marks 54.

Only one carriage swath is required to print the reference marks 56 in pattern A and the offset black marks 58, 60 and 62 in patterns A, C and D, accordingly, the equation for the starting position for the reference black marks 56 is given by the following equation (VII):

$$RBSP=S_h+O_Y \quad \text{(VII)}$$

wherein RBSP is the starting position of the reference black marks 56.

The starting position for the offset black marks 58, 60 and 62 is given by the following equation (VIII):

$$OBSP=S_h+O_Y-(L_b-1) \quad \text{(VIII)}$$

wherein OBSP is the starting position of the offset black marks 58, 60 and 62 and $L_b$ is the number of vertical marks across the print media.

In order to provide the vertical alignment patterns G, H and I, one swath of the carriage for the reference cyan ink color marks is required. Accordingly, the equation for the first reference starting point for the cyan color marks 64, 66 and 68 is provided by the following equation (IX):

$$VRSP_1=S_v+O_Y-O_C \quad \text{(IX)}$$

wherein $VRSP_1$ is the first starting position for the reference color mark 64, 66 and 68, $S_v$ is margin for the alignment pattern on the page, $O_Y$ is the theoretical offset distance between the yellow ink jet pen and the black ink jet pen and $O_C$ is the theoretical offset distance between the cyan ink jet pen and the black ink jet pen.

The second starting position for the reference color marks 64, 66 and 68 in patterns G, H and I is calculated by the following equation (X):

$$VRSP_2=S_v+O_Y-O_C+NPP/2 \quad \text{(X)}$$

wherein $VRSP_2$ is the second starting position for the reference color marks 64, 66 and 68, $S_v$, $O_Y$ and $O_C$ are as set forth above and NPP is the nozzle print periodicity or actual horizontal spacing between dots printed immediately adjacent one another by the same ink jet nozzle.

The first starting position for the offset magenta color marks 70 in pattern H is calculated by the following equation (XI):

$$VOMSP_1=S_v+O_Y-O_M \quad \text{(XI)}$$

wherein $VOMSP_1$ is the first starting position for the offset magenta color marks 70, $S_v$, $O_Y$ and $O_M$ is the theoretical offset between the magenta color and the black color.

The second starting position for the offset magenta color marks 70 in patterns H is calculated by the following equation (XII):

$$VOMSP_2=S_v+O_Y-O_M+NPP/2 \quad \text{(XII)}$$

wherein $VOMSP_2$ is the second starting position for the offset magenta color marks 70.

The first starting position for the offset yellow color marks 72 in pattern I is calculated by the following equation (XIII):

$$VOYSP_1=S_v \quad \text{(XIII)}$$

wherein $VOYSP_1$ is the first starting position for the offset yellow color marks 72, $S_v$ is as defined above.

The second starting position for the offset yellow color marks 72 in pattern I is calculated by the following equation (XIV):

$$VOYSP_2=S_v+NPP/2 \quad \text{(XIV)}$$

wherein $VOYSP_2$ is the second starting position for the offset yellow color marks 72.

Only one carriage swath is required to print the starting position for the offset black marks 74 in pattern G as given by the following equation (XV):

$$VOBSP=S_v+O_Y \quad \text{(XV)}$$

wherein VOBSP is the starting position of the offset black marks 74.

Figure 7:
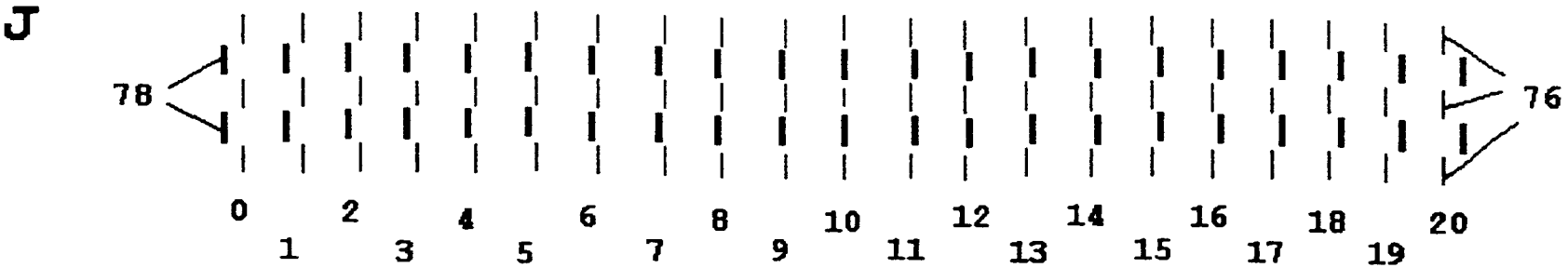
FIG. 7 is a set of vertical line arrays for an alternative alignment pattern for a yellow pen according to the invention.

With reference to FIG. 7, an alternative pattern for determining alignment between the yellow color printhead 32 and the cyan color printhead 28 is provided. In this pattern cyan reference marks 76 are printed as described above. However, yellow color offset marks 78 are preferably printed with lines having a thickness of two or more lines and/or with two or more layers of yellow ink. This provides a pattern J as illustrated in FIG. 7 which enables a user to more easily select the best alignment.

Once all of the unidirectional patterns are printed, the number below the best alignment of the horizontal and vertical reference and offset marks for each pattern is input into the printhead or printer memory for permanent storage. A user creates the bi-directional alignment pattern after purchasing the printer and inputs this into the printer memory during an alignment setup routine. The unidirectional alignment data and the bi-directional alignment data are then combined to provide inputs to an algorithm which adjusts the print routine so that the color and black ink jet printheads are aligned. Periodically, a user may need to run the bi-directional alignment routine again such as when installing a new ink tank on the printer. In this case, new bi-directional alignment data is used with the permanent unidirectional alignment data to provide print image adjustment. When a new printhead is installed on the printer, both the unidirectional and bi-directional alignment routines are required.

In a particularly preferred embodiment the pens have nozzle spacings which provide a print resolution of 600 dots per inch when printing. Accordingly, the unidirectional pattern resolution $R_u=1/600$ inch while the bi-directional alignment resolution $R_b=1/1200$ inch. Since the pen resolution $R_p=1/600$ inch, the unidirectional alignment patterns may be printed in one pass. Using a color pen for the reference marks to measure color-to-color horizontal and vertical offsets results in a reduction in error compared to using black for the reference marks and computing the color-to-color horizontal and vertical offsets from the black-to-color offsets. The reduction in offset errors using the alignment methods according to the invention is illustrated in the following tables. Tables 3 and 4 illustrate the horizontal alignment errors for unidirectional and bi-directional alignment patterns and Table 5 illustrates vertical alignment errors.

TABLE 3

| Unidirectional Alignment | | | |
|---|---|---|---|
| Forward | Forward | Horizontal Error w/Cyan as reference (× 1/2400 inch) | Horizontal Error w/Black as reference (× 1/2400 inch) |
| BK | CN | 2 | 2 |
| BK | MA | 4 | 2 |
| BK | YW | 4 | 2 |
| CN | MA | 2 | 4 |
| CN | YW | 2 | 4 |
| MA | YW | 4 | 4 |

TABLE 4

| Bi-directional Alignment | | | |
|---|---|---|---|
| Reverse | Forward | Horizontal Error w/Cyan as reference (× 1/2400 inch) | Horizontal Error w/Black as reference (× 1/2400 inch) |
| BK | CN | 1 | 3 |
| BK | MA | 3 | 5 |
| BK | YW | 3 | 5 |
| BK | BK | 1 | 1 |

TABLE 5

| Vertical Alignment | | | |
|---|---|---|---|
| Forward | Forward | Vertical Error w/Cyan as reference (× 1/2400 inch) | Vertical Error w/Black as reference (× 1/2400 inch) |
| BK | CN | 2 | 2 |
| BK | MA | 4 | 2 |
| BK | YW | 4 | 2 |
| CN | MA | 2 | 4 |
| CN | YW | 2 | 4 |
| MA | YW | 4 | 4 |

As illustrated by the foregoing Table 4, bi-directional alignment between the black and color pens is substantially improved when an additional bi-directional alignment is performed between a black pen and a color pen, such as cyan, as opposed to when a bi-directional alignment is performed only with a black pen. For unidirectional alignment of the pens, there is an improvement in error between the cyan and magenta patterns and cyan and yellow patterns when cyan is used as the reference color as opposed to black. However, the error is increased between black and magenta and black and yellow when cyan is used as the reference color during unidirectional alignment of the pens. The same result is seen in Table 5 for vertical alignment of the pens. However, printing black and a color other than black in only the forward direction is not efficient and is not a print mode which is often used. The bi-directional alignment error between black and magenta and black and yellow cannot be made within 1/600 inch using black as a reference without adding an additional alignment pattern or reducing the print resolution below 1/1200 inch which is impractical.

It is contemplated, and will be apparent to those skilled in the art from the foregoing specification, drawings, and examples, that modifications and/or changes may be made in the embodiments of the invention. Accordingly it is expressly intended that the foregoing are only illustrative of the preferred embodiments and modes of operation, not limiting thereto, and that the true spirit and scope of the present invention be determined by reference to the appended claims.

What is claimed is:

1. A method for aligning multiple color inkjet printheads to provide ink droplet placement within about 1/600 inch of a desired droplet location which comprises:

providing an ink jet printer containing a printhead carriage for retaining a black ink printhead and a multicolor ink printhead thereon, the black ink printhead containing a black ink pen and the color ink printhead containing at least two pens for providing ink droplets on a print media;

setting the carriage to an initial first position with respect to a first swath direction across the print media;

moving the carriage across the print media in the first swath direction with respect to the initial first position, while depositing ink droplets from a first color ink pen to provide a series of first vertical line segments across a width of the print media, each of the first vertical line segments being spaced a first constant separation distance from a previously printed first vertical line segment, and while depositing ink droplets from a second color ink pen to provide a series of second vertical line segments across the print media, each of the second vertical line segments being spaced a second constant separation distance from a previously printed second vertical line segment, the first and second series of vertical line segments providing a first alignment pattern;

resetting the carriage to the initial first position with respect to the first swath direction across the print media;

moving the carriage across the print media in the first swath direction with respect to the initial first position, while depositing ink droplets from the first color ink pen to provide a series of third vertical line segments across a width of the print media, each of the third vertical line segments being spaced a first constant separation distance from a previously printed third vertical line segment;

moving the carriage across the print media in the first swath direction from an initial second position, while depositing ink droplets from the black ink pen to provide a series of fourth vertical line segments across the print media, each of the fourth vertical line segments being spaced a fourth constant separation distance from a previously printed fourth vertical line segment; the third and fourth series of vertical line segments providing a second alignment pattern;

visually inspecting the printed vertical line segments of the first alignment pattern;

selecting a set of line segments from the first alignment pattern which are in substantial horizontal alignment with one another;

selecting a set of line segments from the second alignment pattern which are in substantial horizontal alignment with one another; and providing the selected set of line segments from the first and second alignment patterns to a substantially permanent printer memory location.

2. The method of claim 1 wherein the first color pen is cyan.

3. The method of claim 2 wherein the second color pen is magenta.

4. The method of claim 2 wherein the second color pen is yellow.

5. The method of claim 1 wherein the first color pen is magenta.

6. The method of claim 5 wherein the second color pen is cyan.

7. The method of claim 5 wherein the second color pen is yellow.

8. The method of claim 1 further comprising resetting the carriage to the initial first position with respect to the first swath direction across the print media;

moving the carriage across the print media in the first swath direction with respect to the initial first position, while depositing ink droplets from the first color ink pen to provide a series of fifth vertical line segments across a width of the print media, each of the fifth vertical line segments being spaced a first constant separation distance from a previously printed fifth vertical line segment, and while depositing ink droplets from a third color ink pen to provide a series of sixth vertical line segments across the print media, each of the sixth vertical line segments being spaced a sixth constant separation distance from a previously printed sixth vertical line segment, the fifth and sixth series of vertical line segments providing a third alignment pattern;

visually inspecting the third alignment pattern;

selecting a set of line segments from the third alignment pattern which are in-substantial horizontal alignment with one another; and providing the selected set of line segments from the third alignment pattern to the substantially permanent printer memory location.

9. The method of claim 8 wherein the first color ink pen is cyan and the third color ink pen is yellow.

10. The method of claim 9 wherein the yellow line segments are printed with at least two layers of ink.

11. The method of claim 10 wherein the yellow line segments are printed with increased line thickness over the line segments printed with the first color ink pen.

12. The method of claim 9 wherein the yellow line segments are printed with increased line thickness over the line segments printed with the first color ink pen.

13. The method of claim 8 wherein the first color ink pen is cyan and the third color ink pen is magenta.

14. A method for aligning multiple color ink jet printheads to provide ink droplet placement within about 1/600 inch of desired droplet location which comprises:

providing an ink jet printer containing a printhead carriage for retaining a black ink printhead and a multicolor ink printhead thereon, the black ink printhead containing a black ink pen and the color ink printhead containing at least two pens for providing ink droplets on a print media;

setting the carriage to an initial first position with respect to a first swath direction across the print media;

moving the carriage across the print media in the first swath direction with respect to the initial first position, while depositing ink droplets from a first ink pen to provide a series of first vertical line segments across a width of the print media, each of the first vertical line segments being spaced a first constant separation distance from a previously printed first vertical line segment;

setting the carriage to an initial second position with respect to a second swath direction opposite the first swath direction across a print media;

moving the carriage across the print media in the second swath direction with respect to the initial second position, while depositing ink droplets from a black ink pen to provide a series of second vertical line segments across the print media, each of the second vertical line segments being spaced a second constant separation distance from a previously printed second vertical line segment, the first and second series of vertical line segments providing a first alignment pattern;

resetting the carriage to the initial first position with respect to the first swath direction across the print media;

moving the carriage across the print media in the first swath direction with respect to the initial first position, while depositing ink droplets from a second ink pen other than black to provide a series of third vertical line segments across a width of the print media, each of the third vertical line segments being spaced a first constant separation distance from a previously printed third vertical line segment;

setting the carriage to the initial second position with respect to the second swath direction opposite the first swath direction across the print media;

moving the carriage across the print media in the second direction from the initial second position, while depositing ink droplets from the black ink pen or the second ink pen to provide a series of fourth vertical line segments across the print media, each of the fourth vertical line segments being spaced a fourth constant separation distance from a previously printed fourth vertical line segment, the third and fourth series of line segments providing a second alignment pattern;

visually inspecting the printed vertical line segments of the first and second alignment patterns;

selecting a set of line segments from the first alignment pattern which are in substantial horizontal alignment with one another;

selecting a set of line segments from the second alignment pattern which are in substantial horizontal alignment with one another; and providing the selected set of line segments from the first and second alignment patterns to a substantially permanent printer memory location.

15. The method of claim 14 wherein the first ink pen is a black ink pen.

16. The method of claim 15 wherein the second ink pen is a cyan ink pen.

17. The method of claim 15 wherein the second ink pen is a magenta ink pen.

18. The method of claim 15 wherein the second ink pen is a yellow ink pen.

19. The method of claim 15 wherein the second and fourth vertical line segments are printed in two swaths of the carriage across the print media.

20. A method for aligning multiple color ink jet printheads to provide ink droplet placement within about 1/600 inch of a desired droplet location which comprises:

providing an ink jet printer containing a printhead carriage for retaining a black ink printhead and a multicolor ink printhead thereon, the black ink printhead containing a black ink pen and the color ink printhead containing at least two pens for providing droplets of ink on a print media;

setting the carriage to an initial first position with respect to a first swath direction across the print media;

moving the carriage across the print media in the first swath direction with respect to the initial first position, while depositing ink droplets from a first color ink pen to provide a series of first and second horizontal line segments across a width of the print media, the first and second horizontal line segments being spaced from one another a first constant separation distance, and while depositing ink droplets from a second color ink pen to provide a series of third and fourth horizontal line segments across the print media, each of the third and fourth horizontal line segments being spaced from one another a second constant separation distance;

resetting the carriage to the initial first position with respect to the first swath direction across the print media;

moving the carriage across the print media in the first swath direction with respect to the initial first position, while depositing ink droplets from the first color ink pen to provide a series of fifth and sixth horizontal line segments across a width of the print media, each of the fifth and sixth horizontal line segments being spaced from one another the first constant separation distance;

moving the carriage across the print media in the first swath direction with respect to an initial second position, while depositing ink droplets from the black ink pen to provide a series of seventh and eighth horizontal line segments across the print media each of the seventh and eighth horizontal line segments being spaced from one another the second constant separation distance;

visually inspecting the printed horizontal line segments;

selecting a set of line segments for the first, second, third and forth horizontal line segments which are in substantial vertical alignment with one another;

selecting a set of line segments from the fifth, sixth, seventh and eighth horizontal line segments which are in substantial vertical alignment with one another; and providing the selected set of line segments to a substantially permanent printer memory location.

21. The method of claim 20 wherein the first color pen is cyan.

22. The method of claim 21 wherein the second color pen is magenta.

23. The method of claim 21 wherein the second color pen is yellow.

24. The method of claim 20 wherein the first color pen is magenta.

25. The method of claim 24 wherein the second color pen is cyan.

26. The method of claim 24 wherein the second color pen is yellow.

27. The method of claim 20 further comprising resetting the carriage to the initial first position with respect to the first swath direction across the print media;

moving the carriage across the print media in the first swath direction with respect to the initial first position, while depositing ink droplets from the first color ink pen to provide a series of ninth and tenth horizontal line segments across a width of the print media, the ninth and tenth horizontal line segments being spaced from one another the first constant separation, and while depositing ink droplets from a third color ink pen to provide a series of eleventh and twelfth horizontal line segments across the print media, the eleventh and twelfth horizontal line segments being spaced from one another the second constant separation distance;

visually inspecting the printed horizontal line segments;

selecting a set of line segments for the ninth, tenth, eleventh and twelfth horizontal line segments which are in substantial vertical alignment with one another, and providing the selected set of line segments to the substantially permanent printer memory location.

28. The method of claim 27 wherein the first color ink pen is cyan and the third color ink pen is yellow.

29. The method of claim 27 wherein the first color ink pen is cyan and the third color ink pen is magenta.

30. The method of claim 23 wherein the yellow line segments are printed with at least two layers of ink.

31. The method of claim 30 wherein the yellow line segments are printed with increased line thickness over the line segments printed with the first color ink pen.

32. The method of claim 23 wherein the yellow line segments are printed with increased line thickness over the line segments printed with the first color ink pen.

33. The method of claim 26 wherein the yellow line segments are printed with at least two layers of ink.

34. The method of claim 33 wherein the yellow line segments are printed with increased line thickness over the line segments printed with the first color ink pen.

35. The method of claim 26 wherein the yellow line segments are printed with increased line thickness over the line segments printed with the first color ink pen.

* * * * *